United States Patent [19]

Goodman

[11] 4,114,414

[45] Sep. 19, 1978

[54] BACKUP ROLL FOR THIN WALLED PIPE GROOVING DEVICE

[75] Inventor: James M. Goodman, East Rochester, N.Y.

[73] Assignee: E.G. Sprinkler Corporation, East Rochester, N.Y.

[21] Appl. No.: 792,249

[22] Filed: Apr. 29, 1977

[51] Int. Cl.[2] ..... B21D 17/04

[52] U.S. Cl. ..... 72/105

[58] Field of Search ..... 72/105, 106

[56] References Cited

U.S. PATENT DOCUMENTS

| | | | |
|---|---|---|---|
| 620,202 | 2/1899 | White | 72/105 |
| 666,672 | 1/1901 | Hoffman | 72/105 |
| 1,724,920 | 8/1929 | Fischer | 72/106 |
| 2,024,803 | 12/1935 | Nelson | 72/105 |
| 3,541,826 | 11/1970 | Halliburton | 72/105 |
| 3,995,466 | 12/1976 | Kunsman | 72/106 |

*Primary Examiner*—Lowell A. Larson
*Attorney, Agent, or Firm*—Shlesinger, Fitzsimmons & Shlesinger

[57] ABSTRACT

The roll comprises a solid, cylindrical, heat-treated steel rod having a threaded stud section on one end, and an externally knurled operating section on its opposite end. The stud section is adapted to thread into a bore formed in one end of the drive or work-rotating shaft of conventional roll grooving apparatus, thereby to support the operating section in the path of a conventional grooving roll which is mounted to reciprocate radially of the drive shaft between operative and inoperative positions. A circumferential groove in the operating section of the backup roll registers with a circumferential boss on the grooving roll. When one end of a piece of thin walled pipe is inserted over the operating section and the grooving roll is advanced against the pipe, the shaft is rotated and rotates the pipe so that the grooving roll forms a groove therein.

5 Claims, 2 Drawing Figures

BACKUP ROLL FOR THIN WALLED PIPE GROOVING DEVICE

Figure 1:
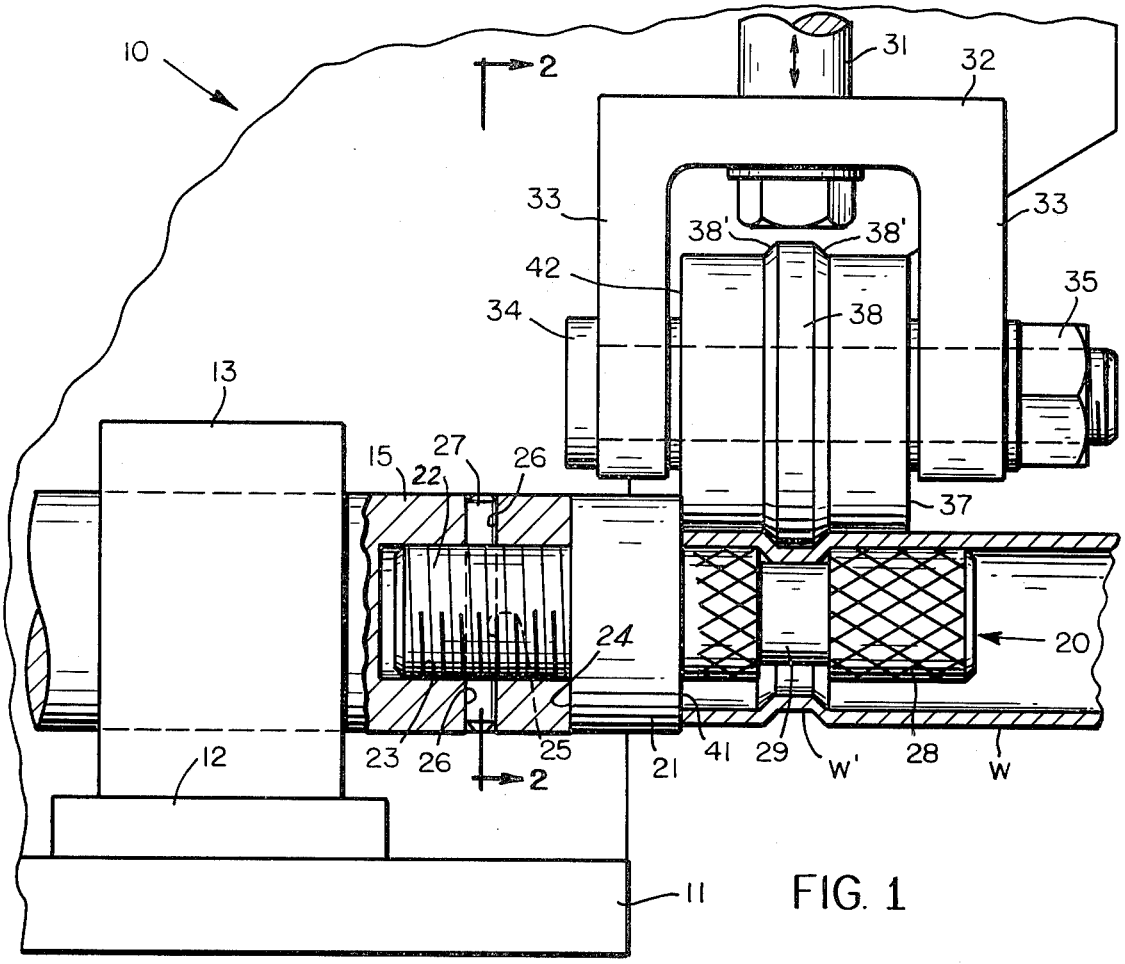

This invention relates to a device for grooving thin walled pipe, and more particularly to an improved backup roll for such a device.

In the grooving of thin walled pipe, it is customary to insert one end of the pipe over one end of a grooved backup roll, and then to force one or more grooving rolls radially into engagement with the thin walled pipe at the point where it overlies the grooved backup roll. Then, by rotating the backup roll and the overlying pipe, the grooving rolls force the thin walled pipe radially inwardly at the location of the underlying groove in the backup roll. The pipe is thus provided with a circumferential groove which corresponds to the groove in the backup roll.

There are a number of known devices for grooving thin walled pipe in the above-noted manner. Heretofore, however, none of these known devices has had the capability of grooving thin walled pipes of rather small diameters, for example pipes having diameters of 1½" or less. For these smaller pipes, it heretofore has been customary to form the grooves by use of a hand-operated grooving device, which is similar to a pipe cutter, and which does not utilize a grooved backup roll for forming the groove.

For a typical, known pipe grooving device of the type which uses a grooved backup roll, reference is made to U.S. Pat. No. 3,903,722, which is cited merely by way of example. In the device illustrated in this patent the grooved backup roll (62) is typical of those currently employed in the industry, in that it is hollow, and has an axial bore (truncated conical in this particular case) which allows it to be inserted removably over one end of a drive shaft (28) which is employed to rotate the backup roll, and the surrounding work (thin walled pipe), when the device is in use. While this construction has been found satisfactory for roll grooving thin walled pipe of relatively large diameters, it has not been possible heretofore to use devices of this type for roll grooving pipes having diameters, for example, of 1½" and less.

The reason for the above-noted difficulties is that, in order to roll groove a piece of pipe by using a backup roll which projects into the bore of the pipe, it is necessary that the backup roll have a smaller diameter than the inside diameter of the groove that is to be rolled into the pipe, otherwise it would not be possible to withdraw the grooved pipe from the backup roll after the grooving operation. Obviously, therefore, in order to roll groove a thin walled pipe having an inside diameter of 1½", so as to form in the pipe a groove having, for example, an inside diameter of 1⅜", it will be necessary to employ a backup roll having an outside diameter of less than 1⅜". This has not been possible in devices of the type noted above which use a hollow, or axially-bored backup roll which is releasably secured over one end of the associated drive shaft, because this would mean that the cumulative outside diameter of both of the removable backup roll and the portion of the drive shaft which projects through its axial bore would have to be less than 1⅜"; and practically speaking, this would mean that the portion of the drive shaft which projects through the bore of the backup roll would have to be reduced correspondingly in diameter. In order to roll groove thin walled pipe having a diameter of 1", this would mean reducing the diameter of the shaft projection to approximately ½" or less, which would mean that the shaft would no longer be strong enough to accommodate the radial load which would be applied to the shaft by the grooving roll during use of the device.

It is an object of this invention, therefore, to provide for roll grooving devices of the type described a novel backup roll which is particularly suited for roll grooving thin walled pipes having relatively small diameters.

Another object of this invention is to provide for roll grooving devices of the type described an improved, solid backup roll which can be removably attached to the drive shaft of the device for grooving thin wall pipes of relatively small diameter.

Other objects of the invention will be apparent hereinafter from the specification and from the recital of the appended claims, particularly when read in conjunction with the accompanying drawing.

Figure 2:
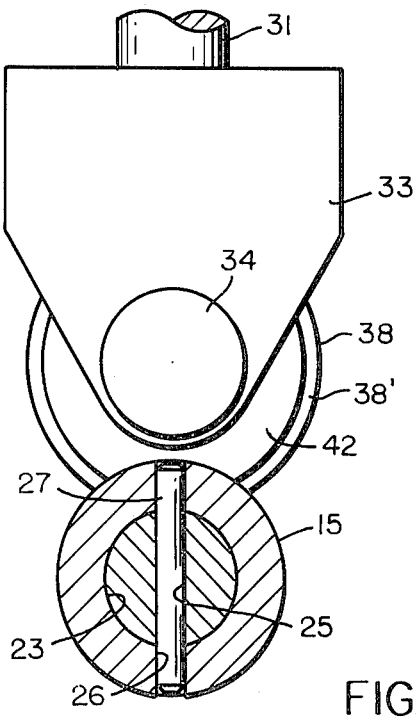

IN THE DRAWING:

FIG. 1 is a fragmentary side elevational view showing part of a roll grooving device made according to one embodiment of this invention, portions of the device being broken away and shown in section; and FIG. 2 is a fragmentary sectional view taken along the line 2—2 in FIG. 1 looking in the direction of the arrows.

Referring now to the drawing by numerals of reference, 10 denotes generally the frame of a roll grooving device having a horizontal platform section 11 on which is secured the base 12 of a conventional needle bearing housing 13. Rotatably journaled adjacent its forward end in needle bearings (not illustrated) contained in housing 13 is a circular drive shaft 15, the rear end of which is drivingly connected in known manner to an electric motor (not illustrated), or the like, which is used to drive the shaft and the work as noted hereinafter.

Releasably secured to the forward end of shaft 15, and projecting coaxially therefrom beyond the forward edge of the platform section 11, is an improved backup roll 20 made according to one embodiment of this invention. Roll 20 is made, for example, from a steel rod, or the like, and has intermediate its ends a circumferential shoulder section 21, which has an outside diameter substantially equal to that of the diameter of shaft 15. Roll 20 has a reduced-diameter, externally threaded shank portion 22, which projects coaxially rearwardly from one side of the shoulder section 21, and which is removably threaded into an internally threaded blind bore 23, which is formed in the outer end of shaft 15 coaxially thereof. When the shank portion 22 of the backup roll 20 has been fully threaded into the bore 23 so that the rear surface 24 on shoulder 21 engages the outer end of the drive shaft 15, a diametral opening 25 in the threaded shank 22 registers with opposed radial openings 26 in the shaft 15, so that a lock pin 27 can be inserted into the registering openings 25 and 26 to lock the roll 20 against rotational movement relative to shaft 15.

Projecting coaxially forwardly from the opposite or outer end of the shoulder 21 is another reduced-diameter, cylindrical section 28, which is externally knurled so as to function as a driving surface for the pipe of work W, that is to be grooved as noted hereinafter. Intermediate its ends the operating or driving section 28 of the backup roll 20 has therein a circumferential groove 29, which is used for the actual grooving operation as noted hereinafter.

Bolted or otherwise secured to the lower end of a post 31, which is mounted in a conventional manner (not illustrated) on the frame 10 for vertical reciprocation above the operating section 28 of the backup roll 20, is a bifurcated yoke member 32. Member 32 has a pair of downwardly projecting legs 33 having in the lower ends thereof registering openings in which a headed bolt 34 is secured by a nut 35, so that the bolt extends between legs 33 above and parallel to the operating section 28 of the backup roll 20.

Mounted to rotate on bolt 34 coaxially thereof between the legs 33 of the yoke 32 is an annular grooving tool or roll 37, which has intermediate its ends an integral, circumferential boss or grooving section 38, which has an outside diameter larger than that of the remaining outer peripheral surface of roller 37. The yoke member 32, of course, is mounted so that the embossed surface 38 on roller 37 registers with the groove 29 on the backup roll 20, with the axes of both the roller 37 and the backup roll 20 lying in a common plane and being parallel to each other. Moreover, the shoulder 21 on the backup roll 20 is designed so that its outer or right hand end 41 is disposed in a plane parallel to, and nearly coplanar with, the plane containing the inner or left hand end 42 of the grooving roll 37, as illustrated in FIG. 1.

In operation the post 31 is elevated from its position as illustrated in FIG. 1 to withdraw the grooving roll 37 to an upper or inoperative position in which it is spaced above the operating section 28 of the backup roll 20. One end of a thin walled pipe or tube W, which is to be grooved, and which is relatively small in diameter, is then inserted over the operating section 28 of the backup roll 20 until the outer end thereof (the left end of the work as illustrated in FIG. 1) engages the plane surface 41 formed on the outer end of the backup roll shoulder 21. The post 31 is then lowered to engage its boss or grooving surface 38 with the work W in the area immediately located around the outside of the groove 29 in the backup roll; and shaft 15 is then rotated so that the downward pressure exerted by post 31 causes the work W to rotate with the shaft 15, while the roll 37 also rotates relative to the work. The pressure of roll 31 is progressively increased in order to cause the work W to be forced or bent downwardly into the groove 29 in the backup roll 20, thereby producing the groove W′ in the work at a point axially spaced slightly from its outer or left end (FIG. 1).

After the groove W′ has been formed in the work, the post 31 is elevated back into its inoperative position, and the work is withdrawn from the forward end of the backup roll 20. It will be noted (FIG. 1) that the inside diameter of the groove W′ which is formed in the work by this operation, is slightly larger than the external diameter of the driving section 28 of the backup roll 20, so that the work can be readily withdrawn from the roll after the grooving operation has taken place.

From the foregoing it will be apparent that the instant invention provides a relatively simple and inexpensive means for enabling the roll grooving of thin wall pipe of very small diameters, for example diameters ranging 1½ and less. This, as above noted, was not possible heretofore except by using apparatus of the type which does not employ a backup roll to support the work during the grooving operation. But with applicant's invention, however, it is now possible to support thin walled pipe of relatively small diameter internally during a roll grooving operation so that the resulting grooving operation can be performed substantially more accurately and rapidly than was heretofore possible. Moreover, since the work is supported internally by the backup roll it is possible to control more accurately the cross sectional configuration of the resulting groove in the work.

For example, as noted in FIG. 1, the embossed grooving surface 38 on the grooving roll 37 has beveled edges 38′ which form corresponding beveled edges in the groove W′ that is finally formed in the work W. This is made possible through the use of the backup roll 20, which enables the concentration of substantially greater grooving pressures in localized areas of the pipe or work W during the grooving operation, as compared to grooving apparatus of the type which does not utilize an internal backup roll or arbor for internally supporting the work during a grooving operation. When a backup roll is not employed, it is not possible rigidly to support both portions of the work which are located immediately adjacent opposite sides of that portion of the work which is engaged by the grooving boss 38, and consequently it is not possible to form a very accurate groove in the work.

Still another advantage of applicant's novel backup roll is that it can be, if necessary, readily removed and replaced by a backup roll of different diameter, or by a backup roll having a groove 29 of different configuration, location or depth. In any case, each such backup roll 20, will consist of a solid, cylindrical member which, in practice, is preferably heat treated to increase its strength and resistance against bending during the actual roll grooving operation, when the upper grooving roll 37 is being urged downwardly against the work, and at which time the upper grooving roll obviously tends to apply a rather large moment or bending force transverse to the axis of rotation of the backup roll 20.

While this invention is particularly suitable for use in the grooving of thin walled pipe, it is to be understood that it could be used for grooving standard wall pipe as well. Moreover, while the invention has been illustrated and described in connection with a preferred embodiment thereof, it will be apparent that it is capable of still further modification, and that this application is intended to cover any such modification that may fall within the scope of one skilled in the art or the appended claims.

I claim:

1. In apparatus for roll grooving metal pipe and the like, and having a drive shaft and a grooving roll mounted for rotation about an axis parallel to said shaft, and for reciprocation radially of said shaft between operative and inoperative positions, the improvement comprising a solid, cylindrical backup roll releasably secured to one end of said drive shaft coaxially thereof, and having a reduced-diameter operating section extending transverse to the path of reciprocation of said grooving roll, and adapted to project into one end of the pipe that is to be grooved, said backup roll having a first transverse, work-engaging surface formed thereon at the inner end of said operating section to engage the terminal end of the pipe that is to be grooved, thereby properly to position the pipe on said operating section, one of said rolls having thereon a circumferential boss, and the other of said rolls having therein a circumferential groove, said backup roll having thereon a second transverse surface rearwardly of said first transverse surface engageable with said one end of said drive shaft when said groove in said other roll is disposed in registry with said boss on said one roll, whereby when one end of a piece of pipe is inserted over said operating section of the backup roll and against said work-engaging surface, and said grooving tool is moved radially to its operative position and said shaft is rotated, said circumferential boss will have rolling engagement with said pipe and will force a circumferential portion of said pipe into the registering groove in said other roll.

2. Apparatus as defined in claim 1, wherein said circumferential boss is formed on said grooving roll, and said circumferential groove is formed in said operating section of the backup roll, said reduced-diameter operating section is formed on one end of said backup roll, a reduced-diameter, externally-threaded shank section projects from the opposite end of said backup roll and is threaded into an axial bore formed in one end of said drive shaft, and the portion of said backup roll between said shank section and said operating section thereof forms at one end said second transverse surface in the form of a circumferential shoulder engageable with one end of said shaft, when said shank section has been threaded as far as possible into said bore in said shaft, and forms at its opposite end said work-engaging surface.

3. Apparatus as defined in claim 2, including a lock pin releasably secured in a diametral opening in said shank section and projecting at opposite ends into registering openings formed in diametrally opposite sides of said drive shaft intermediate the ends of its axial bore.

4. For use with roll grooving apparatus for thin walled pipe, a solid, cylindrical backup roll adapted to be removably secured to one end of a drive shaft which forms part of said apparatus, said backup roll comprising heat-treated steel and having an externally-threaded shank section at one end, an externally-knurled operating section at its opposite end coaxially of said shank section, a circumferential groove in said operating section intermediate the ends thereof, and disposed to register with a circumferential boss on a grooving roll in said apparatus, and a circumferential shoulder separating said shank and said operating sections and having a diameter larger than either of said end sections, said shoulder having on one end a first transverse surface axially spaced from said groove a predetermined distance so as to cause said groove to register with said boss on said grooving roll when the backup roll is mounted on said shaft, and said shoulder having a second transverse surface on the opposite end thereof for engagement by the terminal end of the pipe to be grooved by said backup roll.

5. A backup roll as defined in claim 4, wherein said shank section has therethrough a diametral opening intermediate its ends.

* * * * *